US006771008B2

(12) United States Patent
Williamson

(10) Patent No.: US 6,771,008 B2
(45) Date of Patent: Aug. 3, 2004

(54) STEM CLIP FOR HIGH INTENSITY DISCHARGE LAMP

(75) Inventor: Glen P. Williamson, Manchester, NH (US)

(73) Assignee: Osram Sylvania Inc., Danvers, MA (US)

( * ) Notice: Subject to any disclaimer, the term of this patent is extended or adjusted under 35 U.S.C. 154(b) by 29 days.

(21) Appl. No.: 10/261,136

(22) Filed: Sep. 30, 2002

(65) Prior Publication Data

US 2004/0061444 A1 Apr. 1, 2004

(51) Int. Cl.[7] ..... H01J 5/48; H01J 17/16

(52) U.S. Cl. ..... 313/49; 313/287; 313/290; 313/624; 313/634; 313/318.01; 403/155; 403/12; 403/327; 362/440; 248/205.1

(58) Field of Search ..... 313/283–285, 313/287, 290, 624, 625, 634, 17, 25, 43, 49–51, 318.01, 318.07, 318.1; 403/155, 256, 12, 397, 327; 362/440, 549, 191, 396; 248/205.1, 316.1, 694

(56) References Cited

U.S. PATENT DOCUMENTS 3,224,720 A * 12/1965 Hain ..... 248/313
3,548,235 A * 12/1970 Driedijk et al. ..... 313/404
5,212,422 A * 5/1993 Topel et al. ..... 313/318.01
5,521,458 A * 5/1996 Kulik, Jr. ..... 313/25
6,188,164 B1 * 2/2001 Brown et al. ..... 313/25
6,575,415 B1 * 6/2003 Williamson ..... 248/205.1

* cited by examiner

*Primary Examiner*—Nimeshkumar D. Patel
*Assistant Examiner*—German Colón
(74) *Attorney, Agent, or Firm*—William E. Meyer

(57) ABSTRACT

A mount assembly for a lamp has a glass stem (122) having a first portion (124) that is tubular and has an outside diameter D2 and a second portion (118) formed as a pinch seal. A blow-hole (125) is formed in the tubular first portion and is connected to an exhaust tubulation (126). A substantially C-shaped clip (100) is mounted upon the first portion (124). The C-shaped clip (10) has an inside diameter D that is smaller than the outside diameter D2 whereby the clip (100) frictionally engages the first portion (24). A pair of substantially oppositely located cutouts (102, 104) is formed in the clip (10), each providing an extending flap (106, 108) projecting away from the clip (100). This assembly accurately supports the structure and prevents rotation of the mount assembly. An upstanding tab (110) is located substantially midway between the extending flaps, i.e., opposite the open part of the clip, and angled inwardly toward the center of the C-shaped clip (100). The tab (110) is provided with a hooked end (112) which engages the blow-hole (125) and fixes the position of the clip (100) both vertically and rotationally.

3 Claims, 2 Drawing Sheets

STEM CLIP FOR HIGH INTENSITY DISCHARGE LAMP

TECHNICAL FIELD

This invention relates to lamps and more particularly to mount assemblies for arc discharge lamps. Still more particularly it relates to mount assemblies that are economical to fabricate, suitable for automation, and mounted so as to resist rotation.

BACKGROUND ART

Mount assemblies for arc discharge lamps usually employ a discharge vessel mounted upon a frame. The frame is generally mounted directly to in-leads projecting from a flare. The flare itself comprises a tubular body that can carry the exhaust tubulation and seals the in-leads in a pinch seal. Previous assemblies have employed formed, soft nickel straps that were welded to one leg of a frame, curled manually, welded to a second leg of the frame, placed around the barrel portion of the flare, grasped with pliers and welded together. Further forming conformed the strap to the profile of the flare barrel. Such assemblies are expensive and require a great deal of manual operations to complete. The repetitious hand operations also had unacceptable ergonomic issues. A further assembly that avoided some of these complications is shown in FIGS. 1–3. Therein in FIG. 1 a substantially C-shaped clip 10 is formed from spring steel. The clip 10 has a given height H and an inside diameter D that is smaller than the diameter of the flare with which it is to be employed. The clip 10 has a pair of substantially oppositely located cutouts 12, 14, each providing an extending flap 16, 18 projecting away from the clip. Preferably, the flaps extend away from the clip at an angle of 90°.

The clip is utilized in a mounting assembly 20 for a lamp. The mounting assembly 20 comprises a glass stem or flare 22 that has a first portion 24 that is tubular and has an outside diameter D2 and a second portion 26 formed as a pinch seal having at least one dimension greater than D2.

The substantially C-shaped clip 10 is mounted upon the first portion 24. The given height H of the clip is less than the height of the tubular portion 24 and the inside diameter D is smaller than the outside diameter D2 whereby the clip 10 frictionally engages the first portion 24.

The pair of substantially oppositely located cutouts 12, 14 formed in the clip 10 engage at least a part of the second portion 26, i.e., the pinch seal, of the flare, as seen in FIG. 2.

A first frame member 28 is affixed to the flap 16 and a second frame member 30 is affixed to flap 18. Affixation can be by any suitable technique, such as welding which is preferred.

The mount comprising the clip and the frame is assembled to the flare by aligning the opening in the clip 10 in the longitudinal direction of the pinch seal, attaching the clip to the barrel of the flare, rotating the clip 90°, and then raising the clip until the cutouts 12 and 14 engage the bottom of the pinch seal, thereby preventing further rotation of the clip.

An alternate embodiment is shown in FIG. 3 wherein a clip 10*a* has cutouts 12*a* and 14*a* formed separately from the flaps, only one of which, 18*a,* is shown in FIG. 3.

The remainder of the lamp components, such as the arc tube 32 and a shield 34 can be attached to the frame either before or after the mount assembly is attached to the flare, and then the final connections of the electrical leads can be made.

While this construction provided at great improvement over prior assemblies it occasionally had problems that caused breakage of the mounts. Usually, this breakage occurred because of variations in the thickness of pinch seal. Further, it requires a particular orientation to mount the clip upon the stem and then a second action (raising the clip to engage the pinch seal) in order to complete mounting.

DISCLOSURE OF INVENTION

It is, therefore, an object of the invention to obviate the disadvantages of the prior art.

It is another object of the invention to enhance the assembly of arc discharge lamps.

It is yet another object of the invention to provide a mount assembly that is suitable for automated construction.

It is a further object of the invention to provide a clip that mounts with a single action.

These objects are accomplished, in one aspect of the invention, by the provision of a substantially C-shaped clip formed from spring steel. The clip has an inside diameter D. An upstanding tab is located substantially opposite the open part of the clip and is angled inwardly toward the center of the C-shaped clip. In a preferred embodiment, the end of the upstanding tab is provided with a hooked end.

Additionally, there is provided a mount assembly for a lamp that comprises a glass stem having a first portion that is tubular and has an outside diameter D2 and including a blow-hole connected to an exhaust tubulation. A substantially C-shaped clip is mounted upon the first portion. The C-shaped clip has an inside diameter D that is smaller than the outside diameter D2 whereby the clip frictionally engages the first portion. An upstanding tab is located substantially opposite the open part of the clip and is angled inwardly toward the center of said C-shaped clip. A hooked end of the upstanding tab engages the blow-hole, thus fixing the clip rotationally and vertically. A frame member can be affixed to the clip in any of numerous known ways, such as by providing extending flaps as shown in FIGS. 1–3. Alternatively, a mount structure that uses only a single frame member could be used and it is not necessary that extending flaps be formed on the clip as other forms for mounting the remaining lamp structure can be employed.

This structure provides a unit that can be assembled by automation techniques, thus providing a more efficient, cost effective structure. Further, the frame-clip unit attaches easily to the glass flare by simply pushing it downward upon the flare, allowing the hooked end of the upstanding tab to engage the blow-hole. This is easily accomplished by making the pinch seal no wider than the tubular portion. Additionally, ergonomic issues associated with the prior technique are reduced.

BEST MODE FOR CARRYING OUT THE INVENTION

For a better understanding of the present invention, together with other and further objects, advantages and capabilities thereof, reference is made to the following disclosure and appended claims in conjunction with the above-described drawings.

Figure 4:
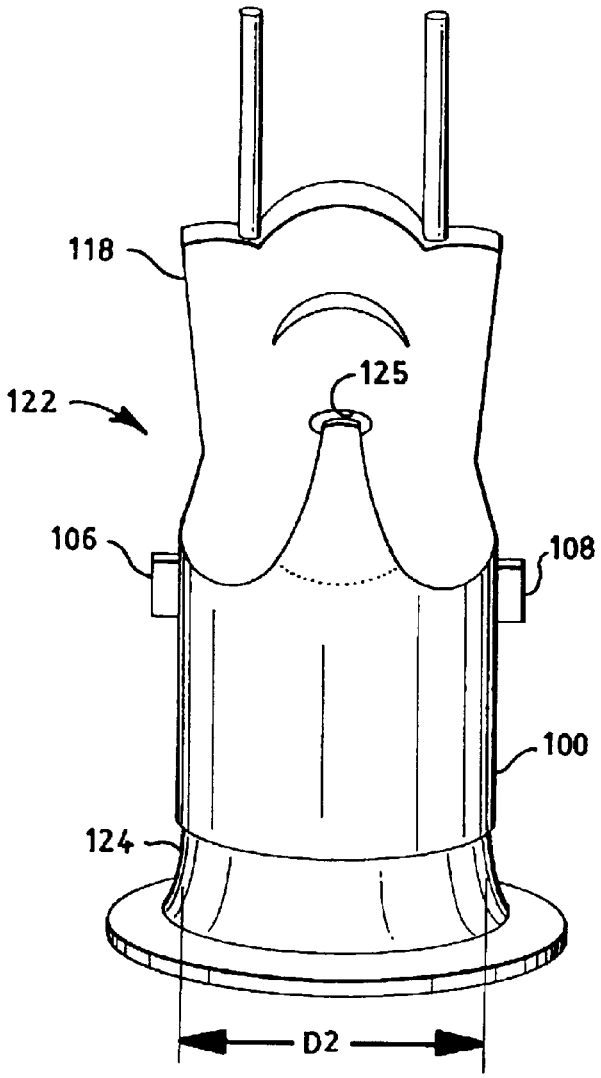
FIG. 4 is a perspective view of an embodiment of the invention.
Figure 6:
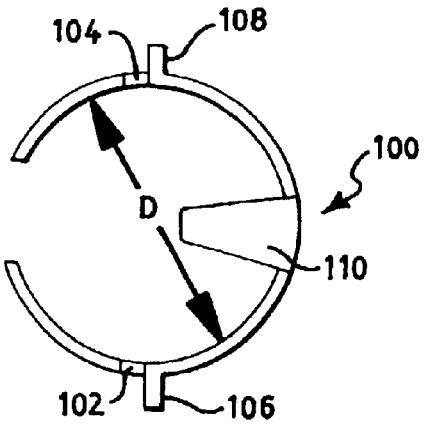
FIG. 6 is a plan view of a clip of the invention.
Figure 5:
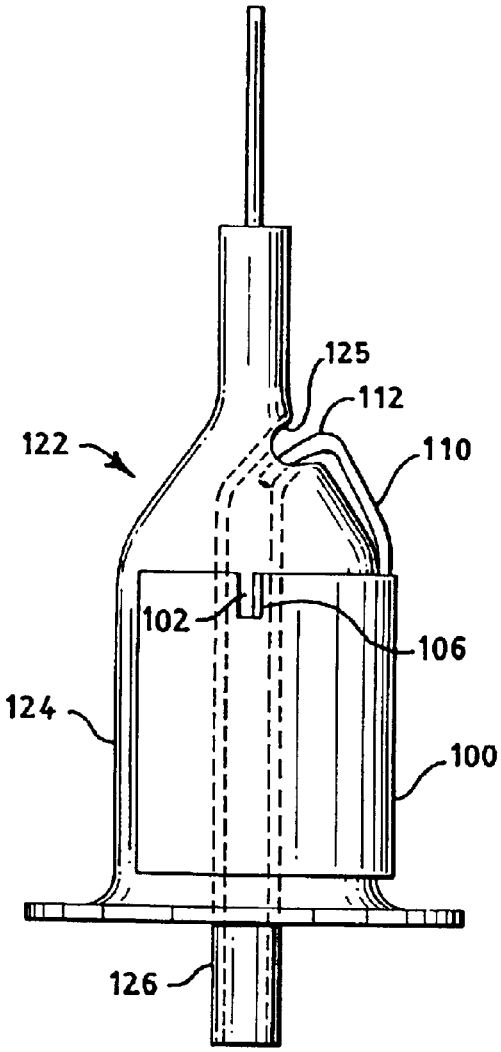
FIG. 5 is an elevational view thereof.

Referring now to the drawings with greater particularity, there is shown in FIG. 4 a substantially C-shaped clip 100 formed from spring steel. The clip has an inside diameter D, and can include a pair of substantially oppositely located cutouts 102, 104 each providing an extending flap 106, 108 projecting away from the clip 100. An upstanding tab 110 is located substantially mid-way between the extending flaps, i.e., opposite the open part of the clip, and angled inwardly toward the center of the C-shaped clip 100. The tab 110 is provided with a hooked end 112, best seen in FIG. 5.

Figure 2:
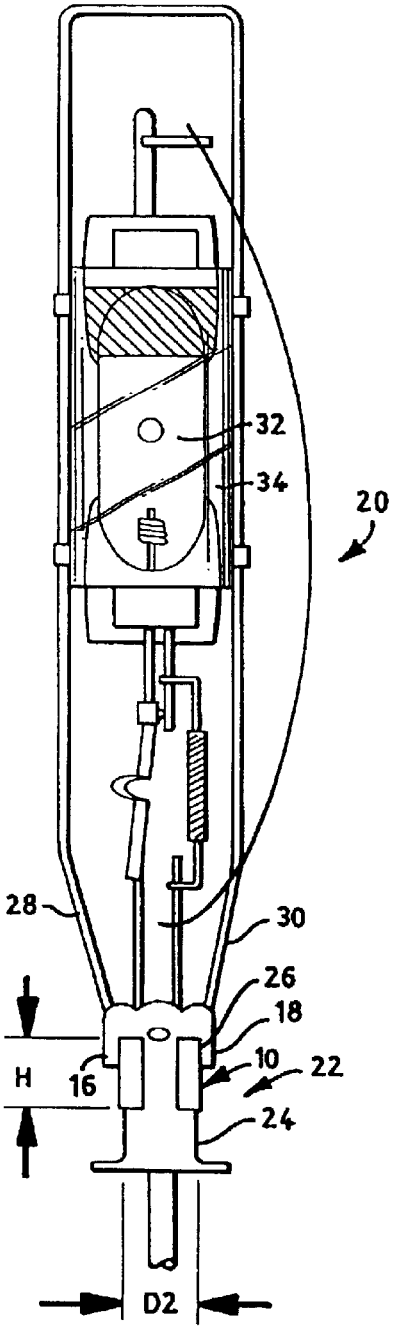
FIG. 2 PRIOR ART
FIG. 2 is an elevational view of the prior art clip mounted upon a glass flare.
Figure 3:
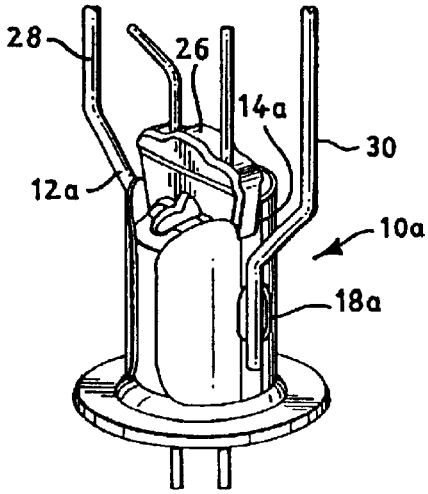
FIG. 3 PRIOR ART
FIG. 3 is a perspective view of an alternate prior art clip.
Figure 1:
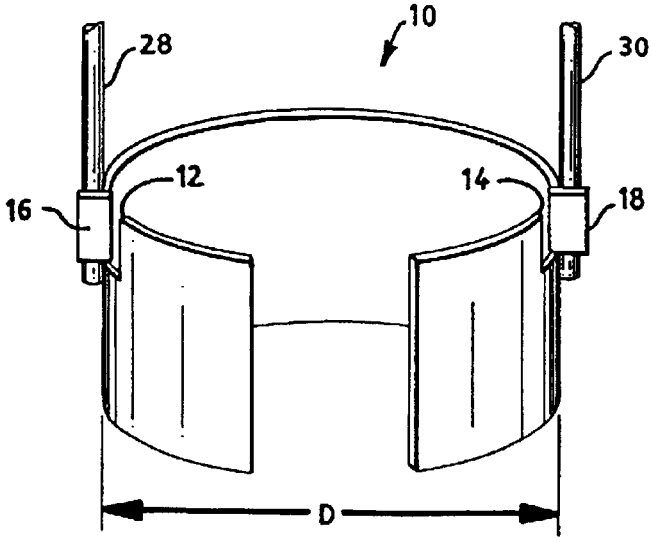
FIG. 1 PRIOR ART
FIG. 1 is a perspective view of a prior art clip.

A mount assembly for a lamp comprises a glass stem 122 having a first portion 124 that is tubular and includes a blow-hole 125 that is connected to an exhaust tubulation 126. The tubular first portion 124 has an outside diameter D2. A second portion of the stem is formed as a pinch seal 118. The substantially C-shaped clip 100 is mounted upon the first portion 124. The inside diameter D of the C-shaped clip is smaller than the outside diameter D2 whereby the clip 100 frictionally engages the first portion 124. The upstanding tab 110 is angled inwardly toward the center of the C-shaped clip 100. The hooked end 112 engages the blow-hole 125 as the clip is positioned on the stem, thus fixing the position of the clip both vertically and rotationally. A frame member, such as frame member 28 shown in FIG. 2, can be attached by any suitable means. In a preferred embodiment that means can be extending flaps 106, 108.

The clip 100 described herein has reduced assembly labor, and provides a simple, vertical lock-in feature. Breakage of the stems is reduced and thus, so is the cost of the lamps with which it is employed.

While there have been shown and described what are at present considered to be the preferred embodiments of the invention, it will be apparent to those skilled in the art that various changes and modification can be made herein without departing from the scope of the invention as defined by the appended claims.

What is claimed is:

1. A mount assembly for a lamp comprising:

a glass stem having a first portion that is tubular and has an outside diameter D2 and including a blow-hole connected to an exhaust tubulation and a second portion as a pinch seal;

a substantially C-shaped clip mounted upon said first portion, said C-shaped clip having an inside diameter D that is smaller than said outside diameter D2 whereby said clip frictionally engages said first portion;

an upstanding tab located substantially opposite the open part of said C-shaped clip and angled inwardly toward the center of said C-shaped clip.

2. The assembly in claim 1, wherein said upstanding tab is provided with a hooked end and said hooked end engages said blow hole.

3. The assembly in claim 1 wherein said C-shaped clip is formed from spring steel.

* * * * *